US008353252B1

(12) United States Patent
Klaschka et al.

(10) Patent No.: US 8,353,252 B1
(45) Date of Patent: Jan. 15, 2013

(54) PROCESS FOR PREPARING A SEAM AREA FOR A PMC BASE FABRIC

(75) Inventors: Susanne Klaschka, Nuremberg (DE); Matthew Ryan, Appleton, WI (US)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 13/311,191

(22) Filed: Dec. 5, 2011

(51) Int. Cl.
*D05B 95/06* (2006.01)
*D03D 25/00* (2006.01)

(52) U.S. Cl. ..... 112/475.08; 139/383 AA

(58) Field of Classification Search ..... 112/415, 112/440, 441, 475.01, 475.08, 1; 139/383 A, 139/383 AA; 162/358.2
See application file for complete search history.

(56) References Cited

U.S. PATENT DOCUMENTS 5,110,672 A 5/1992 Zehle et al.
6,079,454 A * 6/2000 Lee et al. ..... 139/383 AA
6,283,165 B1 9/2001 Best
7,892,402 B2 * 2/2011 Hawes et al. ..... 162/358.2
7,931,051 B2 * 4/2011 Ward et al. ..... 139/383 A
8,043,477 B2 * 10/2011 Crook et al. ..... 139/383 AA
8,083,898 B2 * 12/2011 Best et al. ..... 28/110
8,240,342 B2 * 8/2012 Gstrein et al. ..... 139/383 A

FOREIGN PATENT DOCUMENTS

EP 0261488 A1 3/1988
WO 8912717 A1 12/1989

* cited by examiner

*Primary Examiner* — Danny Worrell
(74) *Attorney, Agent, or Firm* — Taylor IP, P.C.

(57) ABSTRACT

A process for preparing a seam area for a PMC base fabric includes the steps of: providing a PMC base fabric including a plurality of warp yarns extending in a machine direction (MD) and a plurality of interwoven weft yarns extending in a cross machine direction (CD); removing a plurality of adjacent weft yarns from the PMC base fabric to define a window of warp yarns not interwoven with weft yarns, the plurality of warp yarns being interwoven with a plurality of weft yarns on either side of the window; folding over the PMC base fabric at the window such that each warp yarn substantially aligns with itself in the MD, and one or more weft yarns on one side of the window substantially align with a respective weft yarn on an opposite side of the window; and bonding together a portion of the PMC base fabric adjacent the window.

13 Claims, 2 Drawing Sheets

PROCESS FOR PREPARING A SEAM AREA FOR A PMC BASE FABRIC

BACKGROUND OF THE INVENTION

1. Field of the Invention

The present invention relates to paper machine clothing, and more particularly, to a process for preparing a seam area for the clothing in an endless manner.

2. Description of the Related Art

A paper machine clothing (PMC) base fabric is typically manufactured with a specific set of design and quality specifications for a particular paper machine's performance requirements. These specifications include surface characteristics, open area, void volume, permeability and smoothness, among others.

It is known to manufacture a woven press fabric having a flat woven base fabric with a plurality of warp yarns forming seam loops along the ends of the fabric extending in a cross machine direction, transverse to the machine direction. The ends are then placed in end-to-end disposition in order to interdigitate the loops and a pintle wire is then inserted in the interdigitated loops to lock the ends together to bring the fabric into an endless form. For installation in a paper machine of the like, the two ends are separated such that the fabric can be pulled in its direction of movement into the machine, after which the two belt longitudinal ends can then be joined together again. The region of the seam in this case has a larger void area than the rest of the fabric, resulting in a differential dewatering in this area which may lead to marking of the fibrous web. In addition, the formation of seam loops on the base fabric results in increased production time and expense.

PCT Intl. App. No. PCT/GB89/00681, which is assigned to the assignee of the present invention, discloses a seam for a PMC base fabric in which a number of weft yarns are removed from the fabric at a fold location. The fabric is folded over at the fold location, sewed adjacent the fold location, interdigitated with loops from an adjacent fabric end, and a pintle wire is inserted through the interdigitated loops. There is no attempt to align the weft or warp yarns of the folded fabric adjacent the fold location. This configuration provides an effective seam, but the randomly aligned yarns on either side of the window can provide some variability of the seam properties.

What is needed in the art is an improved process for preparing a seam area for a PMC base fabric.

SUMMARY OF THE INVENTION

The present invention provides a seam for a PMC base fabric in which a number of weft yarns are removed from the fabric at a selected seam location, the fabric is folded over where the weft yarns are removed, the warp and weft yarns on either side of the window are aligned with each other, and the fabric is bonded adjacent the window.

The present invention in one form is directed to a process for preparing a seam area for a PMC base fabric including the steps of: providing a PMC base fabric including a plurality of warp yarns extending in a machine direction (MD) and a plurality of interwoven weft yarns extending in a cross machine direction (CD); removing a plurality of adjacent weft yarns from the PMC base fabric to define a window of warp yarns not interwoven with weft yarns, the plurality of warp yarns being interwoven with a plurality of weft yarns on either side of the window; folding over the PMC base fabric at the window such that each warp yarn substantially aligns with itself in the MD, and one or more weft yarns on one side of the window substantially align with a respective weft yarn on an opposite side of the window; and bonding together a portion of the PMC base fabric adjacent the window.

An advantage of the present invention is that the seam has improved physical attributes including consistent loop size, loop alignment, loop spacing and loop stiffness.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
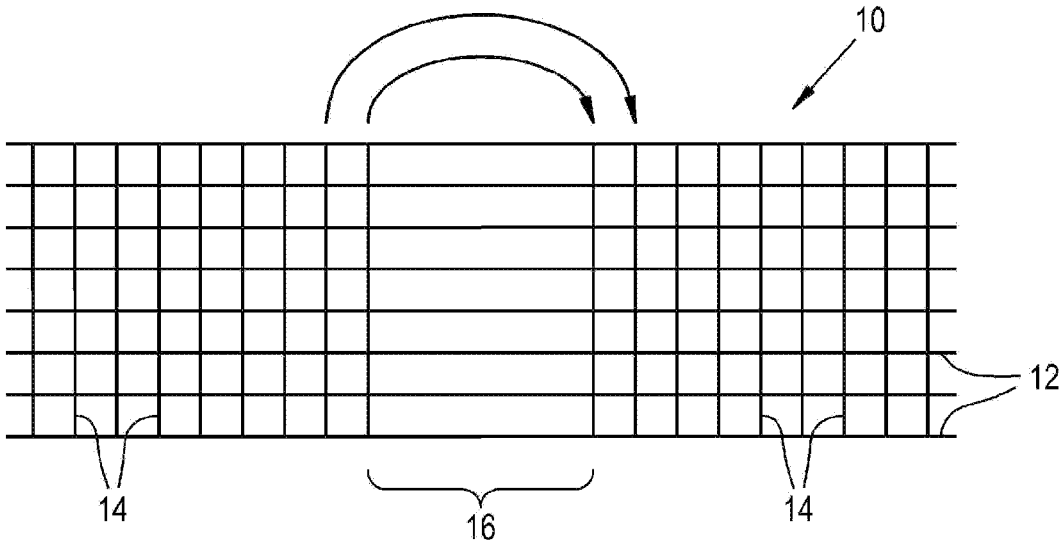
FIG. 1 is a top view of a portion of a PMC base fabric including an embodiment of a seam of the present invention, with a predetermined number of the weft yarns removed to define a window of a folded area.
Figure 2:
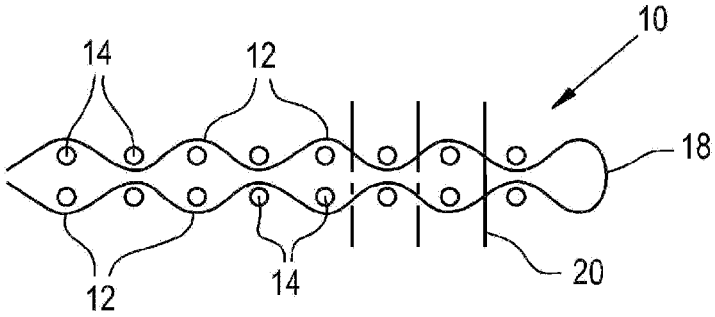
FIG. 2 is a side view of the PMC base fabric of FIG. 1 after being folded at the window.
Figure 3:
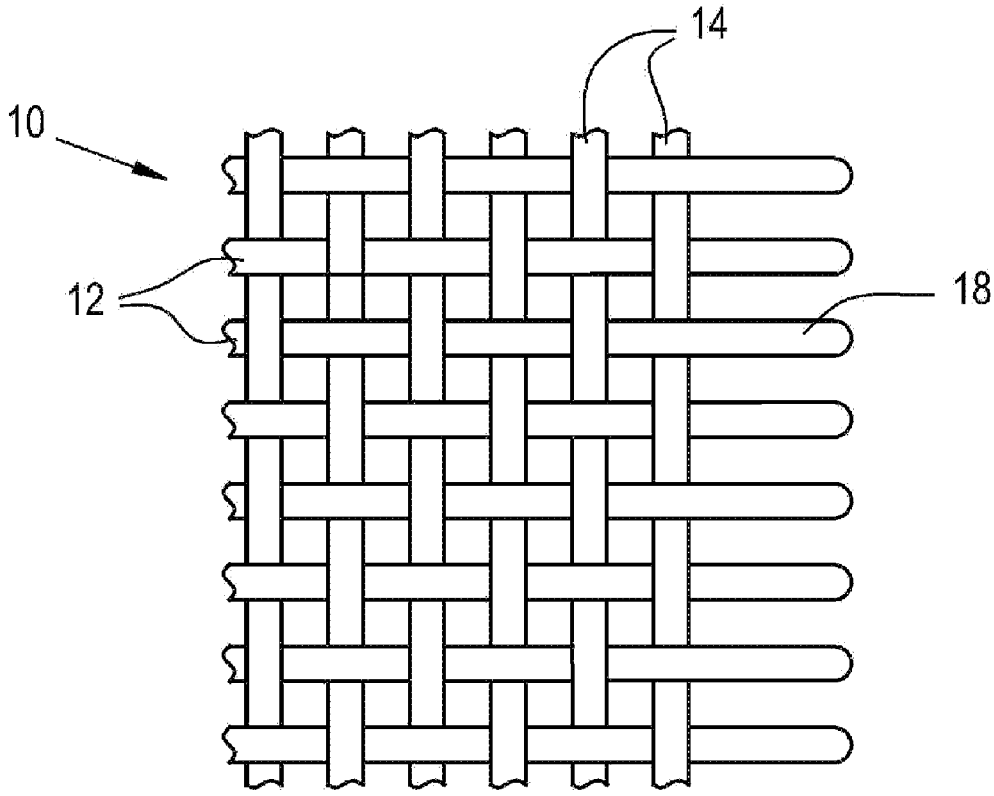
FIG. 3 is a photograph of a top view of a portion of the PMC base fabric shown in FIGS. 1 and 2, with the warp and weft yarns on opposite sides of the window being substantially aligned with each other.

Referring now to the drawings, and more particularly to FIGS. 1-3, there is shown a portion of an embodiment of a PMC base fabric 10 including a plurality of woven monofilament yarns, namely warp yarns 12 extending in the running or machine direction (MD), and weft yarns 14 extending in the cross-machine direction (CD). The specific configuration of fabric 10 may vary, depending upon the application. For example, the specific weave pattern of fabric 10 may vary from one application to another. Warp yarns 12 and/or weft yarns 14 may be comprised of any man-made material, such as nylon, polyester, or other types of poly-yarns.

Referring now more specifically to FIG. 1, during a process for preparing a seam area of PMC base fabric 10, a plurality of adjacent weft yarns 14 are removed from PMC base fabric 10 to define a window 16 of warp yarns 12 not interwoven with weft yarns 14. In the illustrated embodiment, window 16 is defined by 4 weft yarns 14 which are removed from PMC base fabric 10; but could be a different number of removed weft yarns, such as 1 to 8 weft yarns. On either side of window 16, a plurality of warp yarns 12 are interwoven with a plurality of weft yarns 14. The portion of the non-woven warp yarns 12 within window 16 are used to define the loops 18 at the seam of PMC base fabric 10.

PMC base fabric 10 is folded at window 16 such that each warp yarn 12 substantially aligns with itself in the MD, and at least one weft yarn 14 on one side of window 16 substantially aligns with a respective weft yarn 14 on an opposite side of window 16. For example, the weft yarns immediately adjacent to and on opposite sides of window 16 align with each other, the weft yarns which are 2 away from window 16 align with each other, etc. (as shown by the curved arrows above window 16).

When in a folded state, the portion of PMC base fabric 10 defined by window 16 form loops 18 which align with each other in the CD direction. These loops 18 are interdigitated with like loops at an adjacent end of PMC base fabric 10, and a pintle wire (not shown) is inserted through the loops to define the seam.

Prior to insertion of the pintle wire, the portion of PMC base fabric 10 adjacent window 16 is bonded together. The bonding may be carried out using sewing, ultrasonic welding, heat sealing and/or gluing. In the illustrated embodiment, the bonding is by sewing with one or more rows of stitches extending parallel to weft yarns 14 in the CD direction. For example, a single stitch 20 (FIG. 2, shown with a solid line) may be placed between the first and second weft yarns on opposite sides of window 16. Alternate stitch locations are shown by the dashed lines in FIG. 2. Moreover, stitches may be placed at all 3 of the locations indicated in FIG. 2, or additional stitch locations (not shown).

The sewing may be carried out using a lock stitch, chain stitch, bag stitch, back stitch, cable stitch, cover stitch, overcast stitch, and/or over seam stitch. The sewing may be applied as a straight stitch, zig-zag stitch, double needle stitch, or multi-needle stitch. The stitch(es) may be positioned anywhere between 0 to 20 weft yarns away from window 16 (with zero (0) being on a window side of a first weft yarn). The yarn used for the stitches may be a cabled yarn, multifilament yarn, monofilament yarn, knitted yarn, spun fiber yarn, texturized yarn, thermal bonded yarn, low twisted yarn, plied yarn, twisted yarn, soluble yarn, thread or melting yarn. Other common types of yarn used for stitches are also possible. The sewing is carried out with a stitch length of between approximately 15 stitches/cm to 1 stitch/cm. The sewing yarn may be comprised of nylon, polyester, spectra®, cellulose and/or an aramide (such as Kevlar™). The sewing yarn preferably has a dtex rating of between approximately 2 dtex to 400 dtex.

Figure 4:
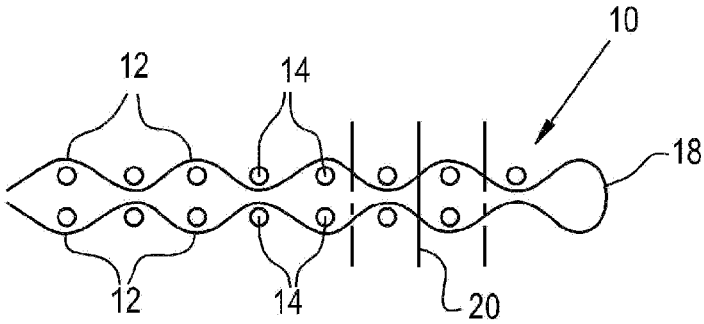
FIG. 4 is a side view of another embodiment of a PMC base fabric of the present invention with the weft yarns being offset relative to each other after being folded at the window.

Referring now to FIG. 4, there is shown another embodiment of the process for preparing a seam area of the present invention in which the weft yarns are offset relative to each other on opposite sides of window 16. That is, the weft yarns which align on opposite sides of window 16 are a different integer number away from window 16. In the illustrated embodiment, the first weft yarn at the bottom of the 2 ply structure aligns with the second weft yarn at the top of the 2 ply structure. A stitch 20 (shown in solid line) is placed between the second and third weft yarns on the top ply, and the first and second weft yarns on the bottom ply. Alternate stitch locations are shown by the dashed lines in FIG. 4.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A process for preparing a seam area for a paper machine clothing (PMC) base fabric, the process comprising the steps of:

providing a PMC base fabric including a plurality of warp yarns extending in a machine direction (MD) and a plurality of interwoven weft yarns extending in a cross machine direction (CD);

removing a plurality of adjacent said weft yarns from said PMC base fabric to define a window of warp yarns not interwoven with said weft yarns, said plurality of warp yarns being interwoven with a plurality of weft yarns on opposite sides of said window;

folding over said PMC base fabric at said window such that each said warp yarn substantially aligns with itself in the MD, and at least one said weft yarn on one side of said window substantially aligns with a respective said weft yarn on an opposite side of said window; and bonding together a portion of the PMC base fabric adjacent said window.

2. The process for preparing a seam area for a PMC base fabric according to claim 1, wherein each said weft yarn on one side of said window substantially aligns with a respective said weft yarn on an opposite side of said window.

3. The process for preparing a seam area for a PMC base fabric according to claim 1, wherein said bonding step includes at least one of sewing, ultrasonic welding, heat sealing, gluing, stitching, laser welding and melt bonding.

4. The process for preparing a seam area for a PMC base fabric according to claim 1, wherein said bonding step includes sewing, and said sewing includes at least one of a lock stitch, chain stitch, bag stitch, back stitch, cable stitch, cover stitch, overcast stitch, and over seam stitch.

5. The process for preparing a seam area for a PMC base fabric according to claim 4, wherein said sewing is applied as one of a straight stitch, zig-zag stitch, double needle stitch, and multi-needle stitch.

6. The process for preparing a seam area for a PMC base fabric according to claim 4, wherein said sewing includes at least one stitch extending parallel to said weft yarns.

7. The process for preparing a seam area for a PMC base fabric according to claim 6, wherein said sewing includes at least one stitch positioned anywhere between a window side of a first said weft yarn up to twenty said weft yarns away from said window.

8. The process for preparing a seam area for a PMC base fabric according to claim 7, wherein said sewing includes one or more rows of stitching.

9. The process for preparing a seam area for a PMC base fabric according to claim 4, wherein said weft yarns are offset relative to each other such that said weft yarns which align on opposite sides of said window are a different integer number away from said window.

10. The process for preparing a seam area for a PMC base fabric according to claim 4, wherein said sewing is carried out with one of a cabled yarn, multifilament yarn, monofilament yarn, knitted yarn, spun fiber yarn, texturized yarn, thermal bonded yarn, low twisted yarn, plied yarn, twisted yarn, soluble yarn, thread and melting yarn.

11. The process for preparing a seam area for a PMC base fabric according to claim 4, wherein said sewing is carried out with a stitch length of between approximately 15 stitches/cm to 1 stitch/cm.

12. The process for preparing a seam area for a PMC base fabric according to claim 4, wherein said sewing is carried out with a yarn comprised of at least one of a nylon, polyester, spectra®, cellulose, and an aramide.

13. The process for preparing a seam area for a PMC base fabric according to claim 4, wherein said sewing is carried out with a yarn having a dtex rating of between approximately 2 dtex to 400 dtex.

* * * * *